United States Patent [19]

Thomé

[11] 4,396,440

[45] Aug. 2, 1983

[54] CRUSHING BODIES FORGED FROM STEEL

[75] Inventor: Michel Thomé, Nouzonville, France

[73] Assignee: Acieries Thomé-Cromback, Paris, France

[21] Appl. No.: 300,739

[22] Filed: Sep. 10, 1981

Related U.S. Application Data

[63] Continuation of Ser. No. 54,297, Jul. 2, 1979, abandoned.

[30] Foreign Application Priority Data

Jul. 11, 1978 [FR] France ..... 78 20687

[51] Int. Cl.[3] ..... C22C 38/36

[52] U.S. Cl. ..... 148/35; 148/36

[58] Field of Search ..... 148/31, 36, 12 R, 12.4, 148/35, 141; 75/126 A, 123 CB, 128 D

[56] References Cited

U.S. PATENT DOCUMENTS

| | | | |
|---|---|---|---|
| 2,182,805 | 12/1939 | Hagenbuch et al. | 148/36 |
| 2,310,987 | 2/1943 | Noderer | 148/12.4 |
| 2,438,267 | 3/1948 | Bonte | 148/35 |
| 2,462,122 | 2/1949 | Nelson | 148/12.4 |
| 2,763,545 | 9/1956 | Breeler | 148/141 |
| 2,771,358 | 11/1956 | Spear | 148/35 |
| 2,883,281 | 4/1959 | Jatczak | 148/35 |
| 3,595,707 | 7/1971 | Faunce et al. | 148/12.4 |
| 3,844,844 | 10/1974 | Sato | 148/35 |
| 3,961,994 | 6/1976 | Thome | 148/12.4 |
| 4,043,842 | 8/1977 | Joiret | 148/35 |
| 4,194,906 | 3/1980 | Kranz et al. | 148/35 |

OTHER PUBLICATIONS

Metals Handbook, "Properties and Selection of Metals", vol. 1, 8th Edition, 1961, pp. 244–249.

*Primary Examiner*—Peter K. Skiff

*Attorney, Agent, or Firm*—Scully, Scott, Murphy & Presser

[57] ABSTRACT

The invention relates to crushing bodies forged from steel having a high carbon content and a finely divided martensitic structure throughout, comprising a carbide content of 2 to 6% by weight, in the form of mixed iron and chromium carbides of the $(Fe, Cr)_3C$ type.

The process for manufacturing these crushing bodies consists in bringing up to a temperature of the order of 900° to 1100° C. a bar or billets of cast or moulded steel and having the desired composition, said bar is possibly cut into billets at said temperature, and said billets are forged at said temperature of 900° to 1100° C.

These crushing bodies allow the crushing of very abrasive materials, for a limited cost.

4 Claims, No Drawings

CRUSHING BODIES FORGED FROM STEEL

This application is a continuation of my earlier filed application U.S. Ser. No. 054,297 filed on July 2, 1979, now abandoned.

The invention relates to crushing bodies made from forged steel. The invention relates also to a process for manufacturing these crushing bodies.

It is known that, in the present state of the technique, crushing bodies are used for crushing either materials having a low wear rate (cements, talc, etc . . . ), or very abrasive materials (different ores, coal, etc . . . ).

In the first case, crushing bodies are used moulded from cast iron having a high chromium content or crushing bodies moulded from heavily alloyed white iron. These crushing bodies cannot unfortunately be used, because of their cost, for crushing very abrasive bodies in a moist environment. For this application, it has then been proposed to use cast iron lightly alloyed (2 to 7% chromium) with chrome carbides of the $M_7C_3$ type (see, for example, French patent application No. 77 31 045 filed on the Oct. 14, 1977 in the name of the applicant), or white hypoeutectic cast irons comprising a carbide cementite structure of the $M_3C$ type on a perlitic base (French patent No. 73 07 662 filed on the Mar. 5, 1973 in the name of TAIHEIYO KINZOKU KABUSHIKI KAISHA), or else lightly alloyed rollable steels having a carbon content less than 1% by weight (steels of the A ISI 1090 type for example) or moulded steels having the same composition.

In practice, these crushing bodies present, depending on their type, a certain number of disadvantages, in particular:

a high cost, due to the use of expensive alloys, such as ferro-chromium or ferro-molybdenum;

a structure which is only case-hardened, with coarse solidification;

a martensitic steel structure due to the rolling, so having a low carbon content (less, generally, than 1% by weight);

a forged hypoeutectic cast iron structure with a very high carbon content, without chromium carbide, with free graphite and a soft matrix, which presents a certain brittleness.

The invention aims at coping with these difficulties by proposing crushing bodies having wear strength characteristics sufficient for crushing very abrasive materials, for a limited cost.

The invention also relates to a process consuming little energy for the manufactur of crushing bodies of this type which are hardened throughout and present a low surface decarbonization.

The applicant has in fact discovered that it is possible to obtain the desired characteristics by providing crushing bodies forged from steel with a high carbon content (hypereutectoid steel).

The invention provides then crushing bodies forged from high carbon content steel, with a finely divided martensitic structure throughout, comprising a carbide content between 2 and 6% by weight, in the form of mixed iron and chromium carbides of the type $(Fe, Cr)_3C$. The crushing bodies of the present invention are useful as finished industrial products. These crushing bodies are non-graphitic, having no graphitic carbon content present therein, basically because an annealing phase is not utilized.

In a preferred embodiment, the crushing bodies of the invention comprise, in percentages by weight, 1.1 to 2% carbon, 0 to 2% chromium with, preferably, 0.5 to 2% silicon and/or 0 to 1% copper and/or 0.5 to 2% manganese.

In order to improve certain characteristics, such as hardening ability or the fineness of the grain, these crushing bodies may contain traces of special elements such as boron (0 to 0.1% by weight), titanium (0 to 1% by weight) or niobium (0 to 0.1% by weight).

To improve certain characteristics, more expensive elements may also be used such as nickel (0 to 3% by weight), molybdenum (0 to 1%) or vanadium.

The process for preparing these crushing bodies is characterized in that we bring up to a temperature of the order of 900° to 1100° C. a bar or billets of cast or mouled steel and having the desired composition, in that said bar is possibly cut into billets at said temperature and in that said billets are forged at said temperature of 900° to 1100° C.

The structure of the starting steel will be fine, preferably perlitic, and will be the result for example of continuous casting.

At the temperature of 900° to 1100° C., the forging will take place in the austenitic region.

The austenitic structure of the forged ball will be used for subjecting it directly to hardening, without previous reheating. In fact, immediately after forging, the ball is at a temperature of 800° to 1000° C., and it may be hardened either in oil or in water, depending on its diameter, for a limited period of time, so that its temperature after hardening is substantially above the temperature of the martensitic transformation $M_S$. The ball is then cooled in the art, so that the martensitic transformation takes place throughout the whole of the volume, without risk of shrinkage cracks or fissures.

This hardening may be followed by low temperature, annealing, between 200° and 500° C., to adjust the hardness of the balls to the application in view.

This treatment, which is made possible by the composition and the structure of the forged material, avoids reheating before hardening and so consumes a very limited quantity of energy.

Furthermore, the elimination of reheating before hardening results in the crushing body having only limited surface decarbonization.

The crushing bodies thus obtained have in general a hardness of 500 to 650 HB.

The micrographic structure is a martensitic solution containing mixed iron and chromium carbides of the $(Fe,Cr)_3C$ type finely divided and distributed homogeneously. The carbide content is about 6% by weight. Their number is of the order of $7000/mm^2$.

The following example illustrates the implementation of the invention.

EXAMPLE 1

Billets are cold cut from a bar of continuously cast steel whose composition by weight is the following:

C: 1.7 to 1.9%
Cr: 0.6 to 0.8%
Si: 0.6%;
Mn: 0.6%;
Cu: 0.5%.

These billets are heated to 1060° C. and they are forged at this temperature to obtain balls of 50 mm diameter, which leave the forging at 1020° C. They are directly hardened in oil to a temperature of the order of 300° C. and they are allowed to cool loose in boxes.

The hardness of the balls thus obtained is between 500 and 550 HB.

What is claimed is:

1. Finished industrial products comprising crushing bodies, for crushing abrasive materials, forged from steel having a high carbon content and a finely divided martensitic structure throughout, said forged steel being non-graphitic and said bodies having no graphitic carbon content therein, and said bodies comprising 1.7 to 2% carbon and 0 to 2% chromium, in percentage by weight; a carbide content of 2 to 6% by weight, in the form of mixed iron and chromium carbides of the $(Fe,Cr)_3C$ type.

2. Crushing bodies are defined in claim 1, when said bodies comprise, in percentage by weight, 0.5 to 2% silicon, 0 to 1% copper, and 0.5 to 2% manganese.

3. Crushing bodies as defined in claims 1 or 2, said bodies comprising traces of special elements such as boron, titanium or niobium.

4. Crushing bodies as defined in claims 1 or 2, said bodies having a $7000/mm^2$ carbides therein comprising a carbide content of approximately 6% by weight and having a hardness of 500 to 650 HB.

* * * * *